United States Patent [19]

Feeney

[11] 3,953,100

[45] Apr. 27, 1976

[54] INFRARED LAMP HOLDER

[75] Inventor: Edward K. Feeney, Worthington, Ohio

[73] Assignee: Liebert Corporation, Columbus, Ohio

[22] Filed: Apr. 4, 1975

[21] Appl. No.: 565,202

[52] U.S. Cl. ..... 339/112 R; 339/117 R; 339/198 R; 339/50 R

[51] Int. Cl.[2] ..... H01R 13/00

[58] Field of Search ..... 339/112 R, 112 L, 15, 339/117 R, 117 P, 16 R, 198 R, 198 S, 198 P, 272 R, 50 R, 57

[56] References Cited

UNITED STATES PATENTS 3,188,459 6/1965 Bridwell ..... 339/50 R 3,217,139 11/1965 Barber ..... 339/198 R

*Primary Examiner*—Roy Lake

*Assistant Examiner*—DeWalden W. Jones

[57] ABSTRACT

A holder for infrared heat source lamps and particularly a holder comprising a block structure having entry sections on both sides separated by a wall. The separating walls provide an entry section oversized and otherwise notched to dissipate heat. A port in each entry section leads to a separate conductive bar positioned on a stair-step surface. The energization protruding wires of the infrared lamps are secured through the ports to the conductive bars. The energization wire power source for the infrared lamps is also connected to the conductive bars. Detailed refinements for positioning the holder in a reflector are disclosed.

10 Claims, 8 Drawing Figures

INFRARED LAMP HOLDER

BACKGROUND

Infrared heat sources are utilized for product baking, heating, drying, and most significantly, for humidification. Infrared humidification is accomplished without the need of physical contact with the water and the heat source (conduction) or the necessity of hot air to carry heat from the heat source to the product (convection). The heat is transferred via radiant energy waves from an infrared energy source to the water as the radiant energy strikes the surfce, the radiation is absorbed and converted into heat. In turn the water converted to vapor is dispersed.

Infrared heat source lamps do not produce products of combustion, thus the product is not contaminated by hot gases from the lamp; there is no flame and no exhausts.

The infrared lamp heats the product instantaneously and cools relatively fast to reduce the start up and down time. Radiant energy utilized in humidifiers produces a pure water vapor - permitting the water contaminents to settle to the bottom of the container.

Heat lamps of the infrared type are commercially available. They generally are the tungsten filament and of the quartz type. In the tungsten type the infrared energy is radiated from the incandescent filament; whereas in the quartz type the infrared radiation is from the surface. The most used infrared lamps are very thin (pencil diameter) and long. At each end there is a base from which the energization wire protrudes. The physical size of the lamps permits several lamps to be included in a single reflector unit to achieve a high concentration of energy.

In those radiant energy reflector units, the holder (sometimes referred to a mount or support) must provide an ample support, ready access to energization, and be able to withstand the high source temperature (400°F) at the base.

The prior art infrared lamp holders are not designed for back-to-back operation - probably because of the heat sink problems. Also the interconnection of the energization source to the protruding wire of the infrared lamp is not an ideal contact.

SUMMARY OF INVENTION

The present invention is for a holder for a plurality of infrared lamps and wherein the lamps may be mounted in a reflector unit back-to-back. The holder is adaptable to the standard type of reflector unit in commercial use. The construction of the holder is that of an overall block with the upper side being in stair-step elevations.

The two sides have a series of walls to provide oversized and notched entry sections capable of dissipating the heat. A port in each entry section leads to the upper side stair-step with each entry section leading to a separate step. The stair-step configuration permits closer spacing of the wires yet maintains the appropriate distance at their ends. Fixedly positioned on each step is a conductive bar with an aperture therethrough on either side and one in the middle area. A set screw arrangement for the apertures secures the energization wire and the outer other side apertures each receive and secure through the entry section ports the wire from the back-to-back lamps. The holder is fixedly positioned in a reflector to provide exact spacing of the wires therebetween. The aforesaid notched areas provide an air flow over and through the reflector. The stair-step configuration, together with the interconnecting energization conductive bars, permits one or all of the lamps to be removed and replaced by simply removing the side panel from the reflector.

OBJECTS

It is accordingly a principal object of the present invention to provide a new and improved infrared lamp holder.

A further object of the infrared lamp holder of the present invention is to provide such a construction that it may hold a plurality of infrared lamps in a back-to-back relationship.

Another object of the infrared lamp holder of the present invention is that the configuration provides a heat dissipation for the high temperature lamp.

Still another object of the infrared lamp of the present invention is that the configuration provides access to the energization terminal of each lamp from a single side of a reflector unit.

Other objects and features of the present invention will become apparent from the following detailed description when taken in conjunction with the drawings in which:

DETAILED DESCRIPTION OF INVENTION

Figure 1:
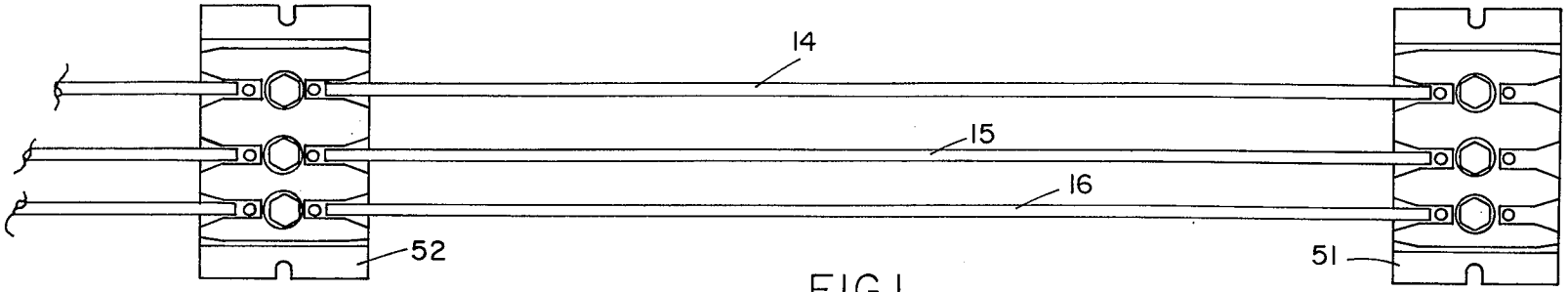
FIG. 1 is an overall illustration of the underside of an infrared heating unit with infrared lamps, a reflector, and a pair of holders of the present invention.
Figure 2:
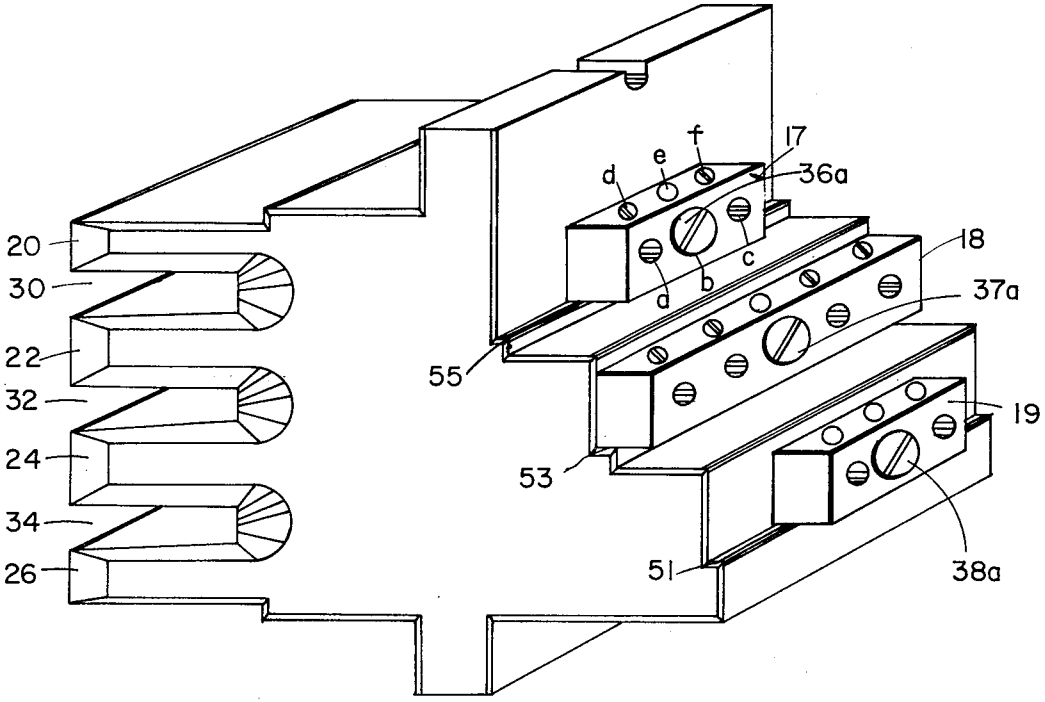
FIG. 2 is a illustration in perspective of the infrared lamp holder of the present invention in its preferred embodiment.
Figure 1A:
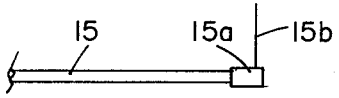
FIG. 1*a* illustrates in part a infrared lamp of the prior art.

The overall infrared heating unit is illustrated in FIG. 1. The unit comprises a reflector 10, having a removal front panel 11, lamps 14, 15, and 16, and holders 12 and 14. The unit as a heat source is utilized in the conventional manner.

With particular reference to FIGS. 2 through 7, there is illustrated the holder of the present invention in its preferred embodiment. The holder is constructed of ceramic or refractory material or the like adapted to withstand the heat of the heating wires 15*b* and the base ends 15*a* of the infrared lamps 15 and to provide die-electric strength. Also the structural material of the holder is such to remain electrically non-conductive even when heated.

Figure 5:
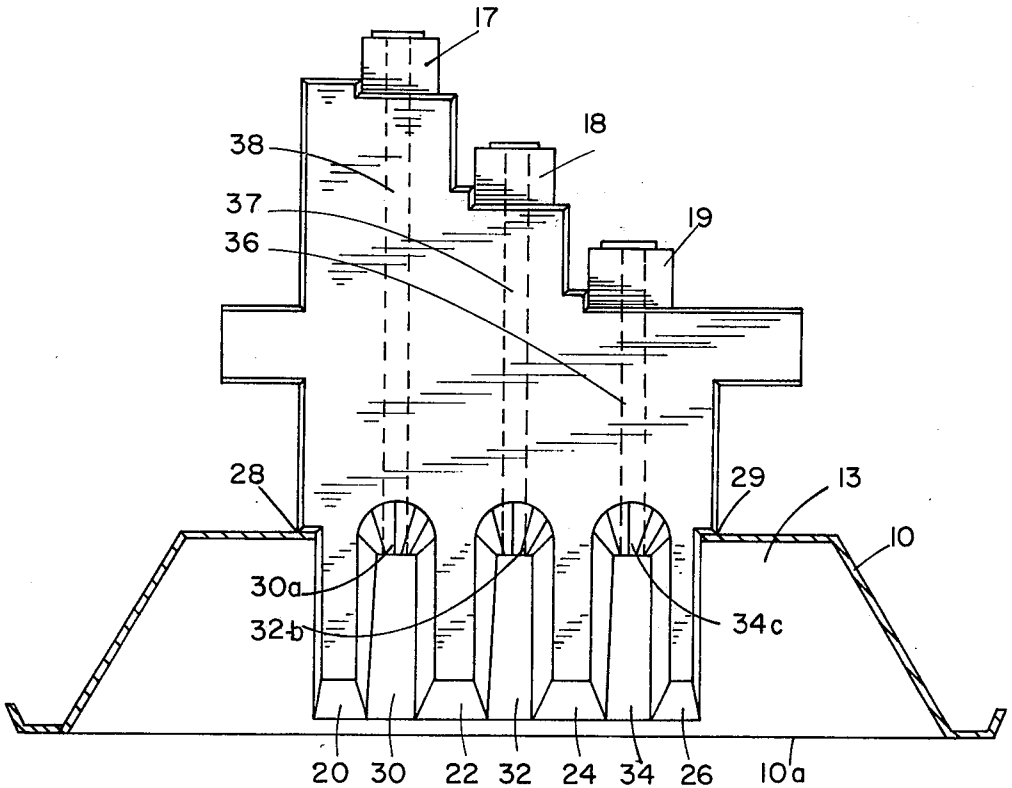
FIG. 5 is a first side view of the holder and reflector of FIG. 1, the reflector being in cross-section.

Referring also to FIG. 5, the holder has a pair of shoulders 28 and 29. When mounted in the reflector 10, these shoulders 28 and 29 rest on the top 13 of the reflector. Positioned on the bottom of reflector 10 is a splash plate 10*a* that is also fitted to the underside of the holder.

Figure 3:
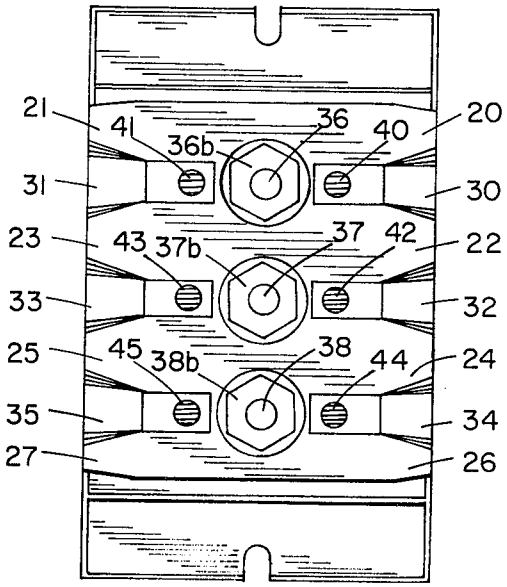
FIG. 3 is a bottom view of the infrared lamp holder of FIG. 2.
Figure 4:
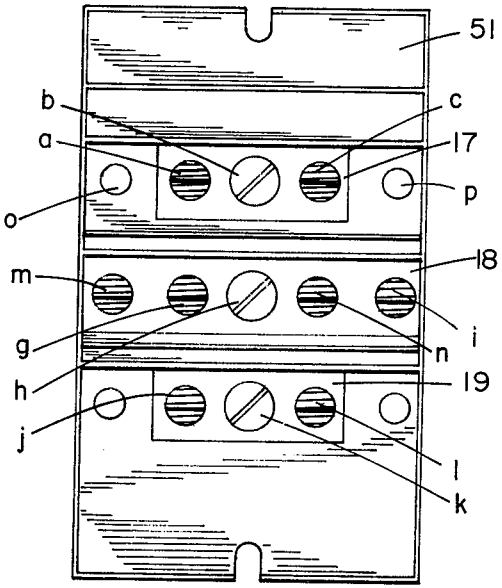
FIG. 4 is a top view of the infrared lamp holder of FIG. 2.
Figure 7:
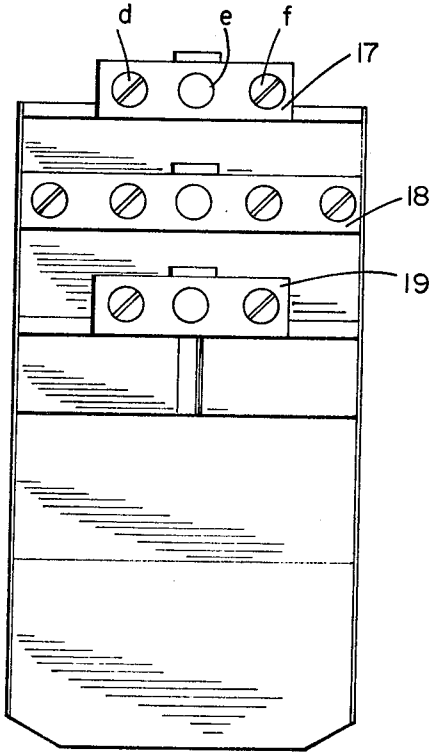
FIG. 7 is an end view of the infrared lamp holder of FIG. 2.
Figure 6:
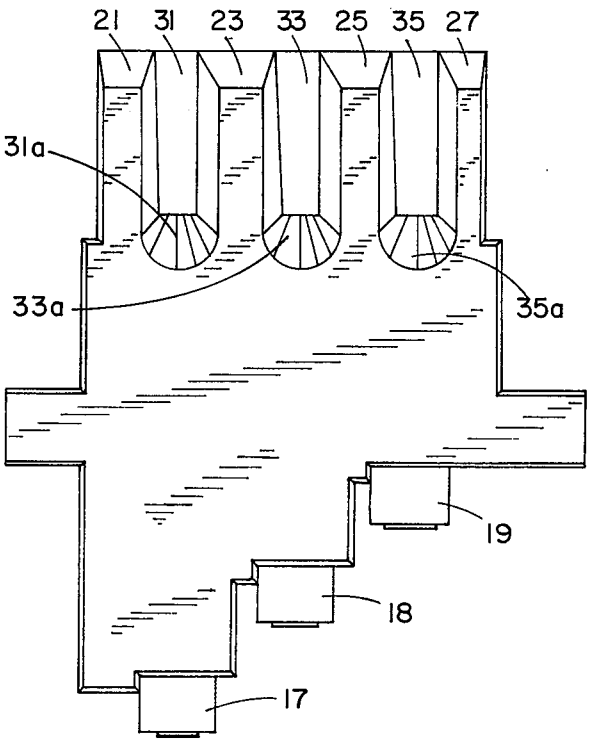
FIG. 6 is a second side view of the holder of the preferred embodiment.

Specifically referring to the end view of FIG. 3, basically the structure has formed therein cavities 30, 32, and 34 on one side and cavities 31, 33, and 35 on the other side. The outside ends 20 and 26 together with the portions 22 and 24 are of fin-like configuration; and similarly, portions 21, 23, 25, and 27 are of fin-like and identical configuration. These fins are the walls that define the cavities. The cavities are the lamp end entry sections. In this embodiment three lamps may be positioned on each side. The entry sections as defined by the walls as aforesaid are much larger than the base of the infrared lamps. In this way air is permitted to circulate therethrough and around the base of the lamps. Also, and again with reference to FIG. 5, the entry sections are notched at 30*a*, 32*a*, 34*a*, 31*a*, 33*a*, and 35*a*. When the holder is mounted in the reflector 10 as shown in FIG. 5, air is permitted to pass over the reflector and down through the entry sections to provide the necessary cooling.

Centrally positioned in each of the upper ends of six entry sections, are bores 40, 42, and 44 in the one side and bores 41, 43, and 45 in the other side. These bores extend upwardly through the entire structure to the top surface of the lamp holder. As shown in FIG. 5 together with FIG. 2 the upper or top surface of the lamp holder is of a stair-step configuration. Positioned on each step is a conductive bar, such as 17, 18, and 19 - also shown in FIGS. 5 and 7. The conductive bar 17 has three bores, *a*, *b*, and *c*, extending therethrough and secondary partial bores *d*, *e*, and *f*, extending 90° from the bores *a*, *b*, and *c*.

The bores 36, 37, and 38 (FIG. 3) extend from intermediate the entry sections through the structure and align with the center bores *b*, *h*, and *k*, of each of the conductive bars 17, 18, and 19. In this way the conductive bars 17, 18, and 19 are mounted to the step top of the holder and secured thereto such as by screws 36*a*, 37*a*, and 38*a* and nuts 36*b*, 37*b*, and 38*b*.

Ridges 51, 53, and 55 restrain the conductive bars from moving radially when being secured or at other times. These ridges also assure that the conductive bars 17, 18, and 19 maintain a minimum spacing. In this respect the stair-step configuration provides additional spacing between the conductive bars 17, 18, and 19. That is, without the stair-step configuration the conductive bars would not meet the code requirements for spacing for high voltage bus bars.

With reference to FIG. 5, there is shown the bores 36, 37, and 38 with two diameters the first diameter to receive the screw and the second to receive the larger nut. It is noted that the three smaller diameter bores are of equal lengths whereas the three larger bores are of different lengths. In this way a single size screw is used for securing the three conductive bars 17, 18, and 19.

In assembling the infrared lamp (such as the T3 infrared lamp manufactured and sold by Westinghouse and General Electric) the base 15*a* of the lamp 15 is placed in the entry portion such as 30 with the energization lead wire 15*b* extending upwardly through the bore 40 and into the bore a of the conductive bar 17. A set screw in the bore d when tightened fixedly positions the lamp wire. The energization wire from a power supply is similarly positioned in the bore c and secured by set screw in bore *d*. The other end of the lamp is positioned in an identical holder on the opposite end of the reflector unit. Additional lamps are positioned in entry portions 42, 44. In a back-to-back relationship lamps are positioned in bores 41, 43, and 45.

The bars 17, 18, and 19 being of metallic conductive material is an electrical bus bar for energizing the lamps when the appropriate power supply wire is fixed therein.

The conductive bars 17 and 19 show three bores, *a*, *b*, and *c*, and with the *j*, *k*, and *l* center bores, *b* and *k* being the mounting bores. The end bores, a of conductive bar 17 and *j* of conductive bar 19, receive the lamp wire; whereas, the other end bore c of conductive bar 17 and 1 of conductive bar 19 receives the energization wire from the power supply. If the holder were in the end of the reflector it would receive only one end of the I.R. lamps, hence, the holder would comprise three conductive bars such as 17 and 19. If the holder were in the center of the reflector it would receive ends of two I.R. lamps as aforesaid. In this instance all three conductive bars would be similar to conductive bar 18 with 5 bores. The two extra bores m and n jumping the energization wire between two end holders. It is to be noted that the bores *o* and *p*, the two extreme bores in the steps of the upper structure do not extend through the holder. Since these bores receive the energization wire the partially filled bore further serves as insulation. In practice the energization wire is jammed into the partial bore and there secured by the set screw.

It can be seen - from an overall consideration of the figures - that the lamp wire is fed into the holder bore and through the conductive bar and secured thereto. With the set screws on the conductive bars exposed by removal of the front panel of the reflector it can be appreciated that replacing the lamps is a relatively simple process.

Although only a certain and specific embodiment has been shown and described, it is understood that modifications may be had thereto without departing from the true spirit and scope of the invention.

What is claimed is:

1. A lamp holder for an infrared heating unit wherein the lamp is of the type having a base at either end and an energization wire protruding from the base, comprising:

a structure having a plurality of cavities in alternate pairs on both sides of its lower end, the number of cavities equal to the number of lamps held thereby;

said cavities adapted for receiving the bases of said lamps, a bore extending upwardly from each of said cavities to the uppermost region of said structure, a conductive bar for each pair of said alternate cavities positioned on the uppermost region of said structure, said conductive bars having bores therein aligned with said bores in said cavities, said bores in said cavities and said conductive bars adapted to receive said lamp wires, and said conductive bars having means for receiving and retaining an energization wire.

2. The lamp holder of claim 1 wherein said cavities are of size greater than said base of said lamp to thereby permit air flow around said base.

3. The lamp holder of claim 1 wherein said uppermost region of said structure is of a stair-step configuration.

4. The lamp holder of claim 3 wherein said stair steps are equal in number to said alternate cavities.

5. The lamp holder of claim 1 wherein said bores in said conductive bars include securing means for retaining said wires.

6. The lamp holder of claim 3 wherein said conductive bars each have a centrally positioned bore and said structure has a centrally positioned bore in alignment therewith, whereby said conductive bars are secured to said stair-step's uppermost region.

7. The lamp holder of claim 6 wherein said last mentioned bores in said structure have dual diameters, the lesser diameter having a length progressive with said stair-step configuration.

8. The lamp holder of claim 3 wherein each of said stair-steps further comprises a ridge for maintaining said conductive bars in alingment.

9. The lamp holder of claim 1 wherein said structure is of ceramic material.

10. The lamp holder of claim 1 wherein said structure further comprises a pair of shoulders for fixedly positioning said holder in said infrared heating unit.

* * * * *